US005378108A

United States Patent [19]

Zelesky

[11] Patent Number: 5,378,108

[45] Date of Patent: Jan. 3, 1995

[54] COOLED TURBINE BLADE

[75] Inventor: Mark F. Zelesky, Coventry, Conn.

[73] Assignee: United Technologies Corporation, Hartford, Conn.

[21] Appl. No.: 218,499

[22] Filed: Mar. 25, 1994

[51] Int. Cl.[6] ..... F01D 5/18

[52] U.S. Cl. ..... 416/97 R; 415/115

[58] Field of Search ..... 416/95, 97 R; 415/115, 415/116

[56] References Cited

U.S. PATENT DOCUMENTS

| | | | |
|---|---|---|---|
| 3,433,015 | 3/1969 | Sneeden | 415/115 |
| 3,572,960 | 3/1971 | McBride | 416/97 R |
| 4,135,855 | 1/1979 | Peill | 416/90 R |
| 4,229,140 | 10/1980 | Scott | 416/97 R |
| 4,601,638 | 7/1986 | Hill et al. | 416/97 R |
| 4,653,983 | 3/1987 | Vehr | 416/97 R |
| 4,720,235 | 1/1988 | Lachance et al. | 416/97 R |
| 5,102,299 | 4/1992 | Frederickk | 416/97 R |
| 5,176,499 | 1/1993 | Damlis et al. | 416/97 R |
| 5,193,975 | 3/1993 | Bird et al. | 416/97 R |

*Primary Examiner*—John T. Kwon

*Attorney, Agent, or Firm*—Edward L. Kochey, Jr.

[57] ABSTRACT

Turbine blade (10) has a plurality of trailing edge discharge openings (28) discharging cooling air. The blade trailing edge has an increasing thickness "E" toward the tip end (16). Discharge openings with the shortened pressure wall "L" have lesser distances "L" toward the tip end.

5 Claims, 2 Drawing Sheets

COOLED TURBINE BLADE

TECHNICAL FIELD

The invention relates to gas turbine blades in particular to blades having a cooling air outlet opening adjacent the trailing edge for cooling the trailing edge.

BACKGROUND OF THE INVENTION

High temperature gas turbine blades normally have an airfoil shaped body. The body has a main portion with a trailing end forming the downstream portion of the airfoil. Air cooling is used since these blades operate near their maximum allowable temperature. This air cooling may involve internal flow convection cooling, or passing air through openings in the blade forming a film cooling on the outside.

A thick trailing edge produces an aerodynamic loss. Therefore it is preferable to use a thin edge at the trailing edge. It is difficult to provide cooling air holes in such a thin structure and it is therefore known to locate air egress holes near the trailing end. These are located on the pressure side providing film cooling of the trailing end. Air passes through the openings to a cutback portion on the pressure side, so that the extreme trailing edge is substantially only the thickness of the suction side wall. This minimum thickness is limited by fabrication problems and strength requirements.

So called "fat tip" blades have evolved because of a desire to locate abrasive particles on the tip of the blade. The normal thin trailing edge provides insufficient surface for the particles. Aerodynamic efficiency is sacrificed only in the 25% or so portion of the blade near the tip. The remainder of the blade has still the thin trailing edge. The extent of the air opening cutback has been uniform throughout the length of the blade. Over temperature distress has been noted at the trailing edge near the blade tip.

SUMMARY OF THE INVENTION

An air cooled gas turbine blade is formed of a hollow body of airfoil shape, with this airfoil shape having a pressure side and a suction side. The body is longitudinally extending from a root end to a tip end. The trailing edge of the body has a thickness "E" which increases toward the tip end so that a tip of sufficient width is provided to retain abrasive particles on the end.

An air supply passage within the body is in fluid communication with a plurality of trailing eddie air discharge openings. Each opening has a passageway of width"S" and passes adjacent a suction side wall on the suction of the airfoil. This suction wall extends completely through to the trailing edge. A pressure wall on the pressure side of the airfoil is shortened a distance "L" from the trailing edge at the location of each discharge passage. The pressure wall has a thickness "T" at the discharge opening. The distance "L", which is the length of the cutback of the pressure wall from the tip of the blade, is a variable with this length being less toward the tip end where the trailing edge is thick than it is at the root end where the trailing edge is thin. Preferably the width "S" of each passage is the same and the thickness "T" of the pressure wall at each discharge opening is the same, with the ratio of "T" to "S" being equal to or less than 0.8.

DESCRIPTION OF THE PREFERRED EMBODIMENT

Figure 2:
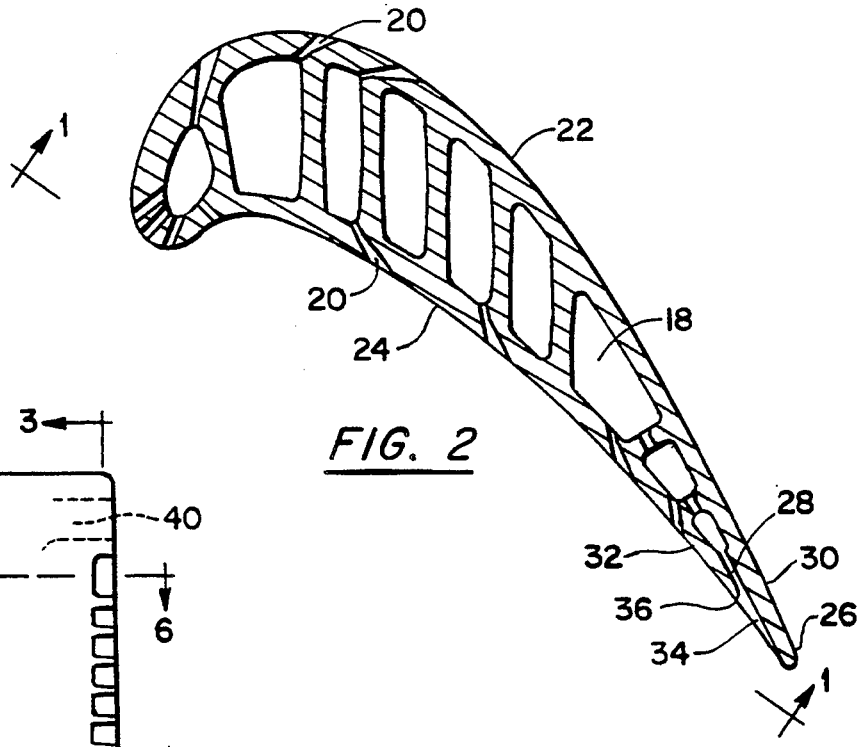
FIG. 2 is a section through the turbine blade 60% of the span showing the airfoil shape.
Figure 1:
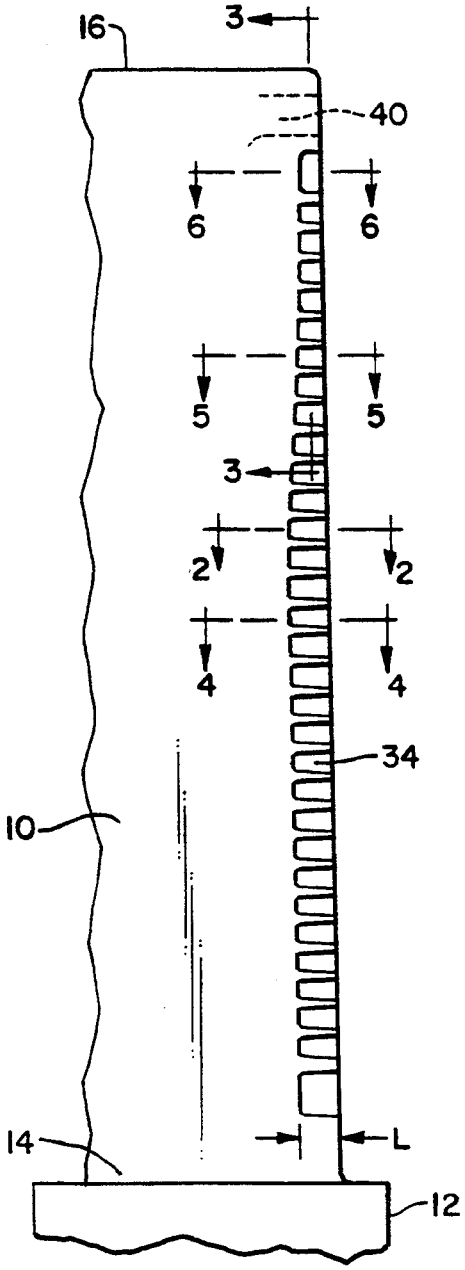
FIG. 1 is an elevation of the turbine blade.

In FIG. 1 there is shown the gas turbine blade 10 secured to a rotor 12 and having a root end 14 and a tip end 16. The blade 10 is of a hollow body longitudinally extending from the root end to the tip end. It is of an airfoil shape as shown in FIG. 2 which is a section taken through 2—2 of FIG. 1. The body has air supply passages 18 passing within the body for conveying cooling air to various locations. A portion of the cooling air passes through film cooling openings 20 to pass cooling air along the outer surface of the blade. Such cooling air cools both the suction side 22 and the pressure side 24 of the blade. The blade has a trailing edge 26 which is thin to minimize aerodynamic losses.

A plurality of trailing edge discharge openings 28 are located throughout the span of the blade with each being in fluid communication with the air supply passage 18. A suction wall 30 extends completely to the trailing edge 26 while the pressure wall 32 is cutback at the location of each air supply passage 28. This permits the trailing edge 26 to be cooled by the flow of air with the relative size of the opening end thickness of pressure wall 32 being important to achieve optimum cooling with relatively low flows.

Figure 3:
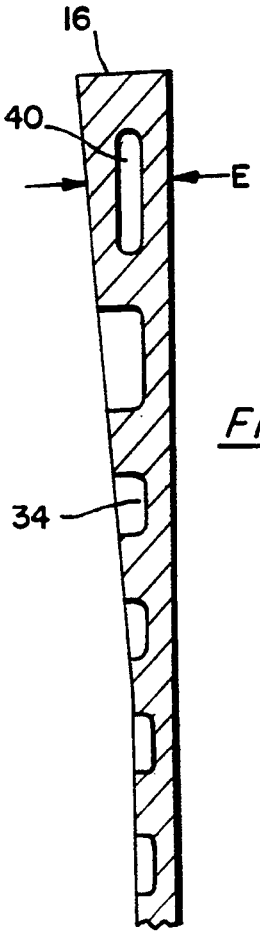
FIG. 3 is an end section through the cooling air opening showing the increased thickness of the trailing edge toward the tip end.

An edge view, FIG. 3, taken through 3—3 of FIG. 1 near the trailing edge shows that the trailing edge has an increasing thickness "E" as it approaches the tip end 16 of the blade. Each recess 34 formed between the trailing edge 26 and the cutback end 36 of the pressure wall decreases toward the tip end of the blade.

Figure 4:
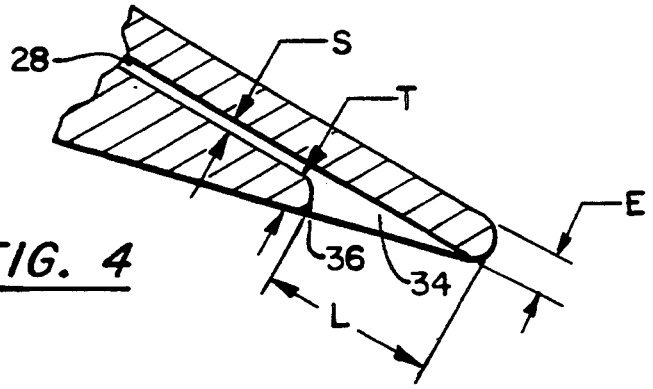
FIG. 4 is a plan section at 50% of the span.

FIG. 4 is a section through the blade taken at 50% of the span. Passageway 28 has a width "S" of 0.015 inches (0.38 mm). The thickness "T" of the pressure wall end 36 is 0.012 inches (0.304 mm) with the length of cutback 34 having a length "L" of 0.12" inches (3.05 mm). The thickness of the trailing edge "E" at this location is 0.035" inches (0.89mm). The ratio of "T" to "S" is 0.8, and may be less.

Figure 5:
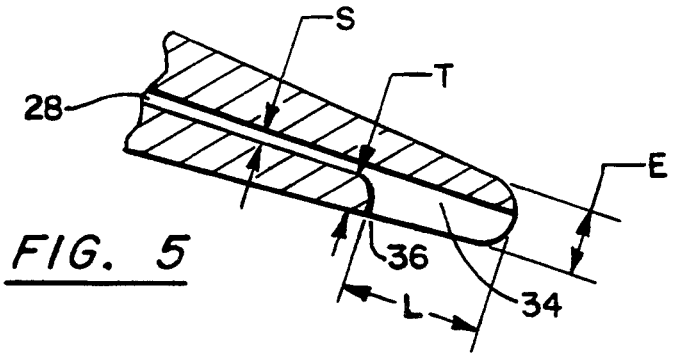
FIG. 5 is a plan section at 75% of the span.

FIG. 5 is a section taken through the blade at 75% of the span. The thickness "E" here is increased to 0.054" inches (1.37 mm). The width "S" of passage 28 remains at 0.015 inches (0.38 mm) and the thickness "T" of the end 36 of the pressure wall remains at 0.012 inches (0.030 mm). The length "L" is however reduced to 0.10" inches (2.5 mm) so that the ratio of "T" to "S" remains at 0.8.

Figure 6:
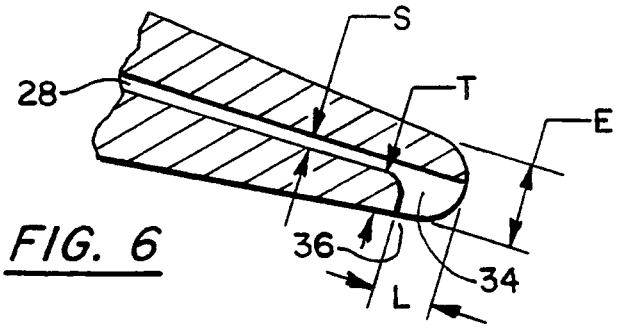
FIG. 6 is a plan section at 90% of the span.

FIG. 6 is a section taken at 90% of the span. Here the width of the tip has increased with the "E" dimension being equal to 0.068 inches (1.73 mm). Again "S" remains 0.015 inches (0.038 mm) while "T" remains 0.012 inches (0.0304 mm). "L" is further reduced to 0.045" inches (1.14 mm) .

The reduction in the length "L" as the dimension "E" or thickness of the tip increases permits the ratio "T" over "S" to be maintained at approximately 0.8. This has been found to be the optimum condition for providing appropriate cooling of the tip 26 without the use of excess cooling air.

A totally enclosed cooling air opening 40 is supplied at the very end of the tip where the heat load is not only imposed from the side of the blades but also the end.

I claim:

1. An air cooled gas turbine blade comprising:

a hollow body of airfoil shape with a pressure side and a suction side, said body longitudinally extending from a root end to a tip end;

said body having an airfoil trailing edge of a thickness "E" increasing toward the tip end;

an air supply passage within said body;

a plurality of trailing edge air discharge openings, each in fluid communication with said air supply passage, and having a passageway of width "S";

a suction wall on said suction side extending completely to said trailing edge;

a pressure wall on said pressure side, shortened a distance "L" from said trailing edge at the location of each discharge passage, whereby said pressure wall has a thickness "T" at the discharge opening; and the distance "L" at discharge openings toward the tip end of said body being less than toward the root of said body.

2. A gas turbine blade as in claim 1 further comprising:

said thickness "E" being constant for 65% of the longitudinal extent of said body from said root end and increasing thereafter.

3. A gas turbine blade as in claim 1 further comprising:

the width "S" of each passage being the same.

4. A gas turbine blade as in claim 3 further comprising:

the thickness "T" at each discharge opening being the same.

5. A gas turbine blade as in claim 4 further comprising:

the ratio of "T" to "S" at each opening being equal to or less than 0.8.

* * * * *